US005755588A

United States Patent [19]

Sweatman et al.

[11] Patent Number: 5,755,588

[45] Date of Patent: May 26, 1998

[54] RETENTION ENCLOSURE FOR IN-LINE ELECTRICAL PLUGS

[76] Inventors: Bobby Sweatman, 5445 Crow Rd., Cumming, Ga. 30131; Michael Mayne, 2600 White Rd., Conyers, Ga. 30207

[21] Appl. No.: 641,507

[22] Filed: May 1, 1996

[51] Int. Cl.[6] ..... H01R 13/62

[52] U.S. Cl. ..... 439/369

[58] Field of Search ..... 439/367, 368, 439/369, 453, 455, 465, 467, 371

[56] References Cited

U.S. PATENT DOCUMENTS

| | | | |
|---|---|---|---|
| 3,344,393 | 9/1967 | Hendee | 439/369 |
| 4,143,934 | 3/1979 | Siebert | 339/75 |
| 4,204,738 | 5/1980 | Tillotson | 339/75 |
| 4,440,465 | 4/1984 | Elliott et al. | 339/75 |
| 4,514,026 | 4/1985 | Herbert | 339/75 |
| 4,643,505 | 2/1987 | House et al. | 439/369 |
| 4,784,612 | 11/1988 | Ryan | 439/367 |
| 4,875,874 | 10/1989 | Windsor, Jr. | 439/364 |
| 4,907,984 | 3/1990 | Keller | 439/369 |
| 4,917,626 | 4/1990 | Barton | 439/369 |
| 4,927,377 | 5/1990 | Bach et al. | 439/371 |
| 5,129,839 | 7/1992 | VanSkiver | 439/367 |
| 5,135,409 | 8/1992 | Thompson | 439/367 |
| 5,147,216 | 9/1992 | Shotey | 596/781 |
| 5,211,573 | 5/1993 | Cross | 439/369 |
| 5,217,387 | 6/1993 | Hull et al. | 439/367 |
| 5,259,782 | 11/1993 | Giffin | 439/367 |
| 5,306,176 | 4/1994 | Coffey | 439/367 |
| 5,328,384 | 7/1994 | Magnuson | 439/369 |
| 5,334,042 | 8/1994 | Chevalier | 439/369 |
| 5,336,107 | 8/1994 | Sheryll | 439/369 |
| 5,443,397 | 8/1995 | Carl | 439/369 |

*Primary Examiner*—Khiem Nguyen
*Assistant Examiner*—Yong Kim
*Attorney, Agent, or Firm*—Troutman Sanders LLP; Joel S. Goldman; Gerald R. Boss

[57] ABSTRACT

An enclosure for retaining an electrical connection between a receptacle from a first electrical cord and a plug from a second electrical cord comprises a lower shell hingedly attached to the upper shell and a latch for securing the upper and lower shells into a closed position. In a first embodiment, an inside surface of one or both of the shells may include an elongated protrusion extending into the enclosure interior space for deformably engaging lateral surfaces of the receptacle and plug, thereby creating a frictional force to resist connection separation. The enclosure may also include protrusions or sectional annuli for engaging the first and second cords for resisting cord movement during the application of tensile loads on the electrical connection. Finally, the enclosure may also include a sheath fixed to the receptacle or plug. The sheath includes a retractable protrusion for releasably engaging a crenelated portion on an side surface of the enclosure to secure on portion of the connection, and at least one gripping protrusion engages one of the electrical cords to secure the entire connection within the enclosure.

36 Claims, 4 Drawing Sheets

RETENTION ENCLOSURE FOR IN-LINE ELECTRICAL PLUGS

BACKGROUND OF THE INVENTION

1. Technical Field

This invention relates generally to an enclosure for receiving an electrical connection. More particularly, the present invention relates to a device for preventing a plug from a first electrical cord from withdrawing from the receptacle of a second electrical cord when the first and second cords are under tension.

2 . Description of the Prior Art

During construction of various structures, electrical extension cords provide electrical power to a multitude of power tools on a construction site. Frequently, construction personnel connect plugs and receptacles from several electrical cords together to form a longer cord to reach remote areas of the site. Although the plug and receptacle resist tensile force to prevent separation, the ability of most connections to resist prolonged tension from dragging or hanging the cords is usually inadequate and results in separation of the connection, causing work delays and other inconveniences.

Attempts to solve the connection separation problem may include tying a knot between first and second cords to avoid separation. However, that solution has proved inadequate, since the twisting action on the cords lessens the lives the extension cords involved. Additionally, the knot may serve to decrease the cross-sectional areas of the metal wires within the cords causing resistive heating near the connection, and possibly the start of a fire. Furthermore, the knot is rather cumbersome and gets caught on various structural corners and obstacles at the job site, causing additional inconvenience to construction personnel.

Some artisans have attempted to enclose the electrical connection within a container for protecting the connection from moisture or from becoming disconnected. Those attempts have met with little acceptance within the construction industry for various reasons set out below.

Other artisans have created devices which utilize metal clips, flexible straps or clamps for partially enclosing and retaining the connection between a plug from a first electrical cord and a receptacle from a second electrical cord. Although each of those devices may maintain the connection between the first and second cords, there are various disadvantages associated with their particular designs, as is also set out below.

For example, U.S. Pat. No. 4,204,738 discloses an electrical connector which utilizes a wire clip on the plug of the first cord which engages one of a plurality of annular ridges on the cord of a receptacle. This combination is disadvantageous because it requires special equipment for both the plug and receptacle. Specifically, it requires that the cord carrying the receptacle include a portion having the series of annular depressions, which increases the cost of the extension cord and decreases the effectiveness of using the metal clip with other extension cords.

U.S. Pat. No. 4,440,465 utilizes a connector lock assembly having a lock member connected to each of the extension cords with a collar portion which is releasably secured to each of the cords. Unfortunately, that connector includes a series of protrusions and matching depressions on the respective locking members which may easily wear out. Furthermore, this device leaves corners of the plug and receptacle exposed and susceptible to catching on corners in a construction site.

U.S. Pat. No. 4,514,026 discloses a plug locking device which is comprised of an elongated strap attached to one extension cord plug by insertion of a first prong into a first opening at one end of the connecting strap. That same end includes additional prongs which are used to attach the second end in a wrapping configuration about the coupled receptacle and plug. However, the elongated nature of the strap amounts to a cumbersome mechanism for securing receptacle and plug. Additionally, if the electrical connection between the plug and receptacle is dragged around a construction site, the strap may easily wear and break.

U.S. Pat. No. 4,875,874 discloses a connector securing arrangement which includes a receptacle for a first extension cord having a pivotally mounted latch member and a compatible plug on a second extension cord which accepts the latch to create a secure connection. Problems with that configuration include the use of a moving part on the receptacle and the requirement that the plug on another extension cord be complementary to accept the latch from the receptacle. Therefore, the receptacle is not compatible with plugs from other extension cords.

U.S. Pat. Nos. 4,907,984, 4,917,626 and 5,366,107 each disclose various strapping mechanisms which retain a receptacle and plug in a connected fashion. The disadvantage of those configurations stems from the thin nature of the strap, making the strap susceptible to wear and breakage if construction personnel consistently drag the connection across rough surfaces on a construction site. Furthermore, those designs do not prevent corners of the plug and receptacle from catching on sharp corners in the construction site.

U.S. Pat. Nos. 5,328,384, 5,334,042 and 5,443,397 each disclose various external clamping means which retain the connection between a receptacle from a first extension cord and a plug from a second extension cord. Disadvantages with those connection devices include their expense due to the requirement of metal parts, and exposure of connection corners allowing the corners to catch on various sharp objects and corners in a construction site.

U.S. Pat. No. 4,143,934 discloses an enclosure for retaining an electrical connection between a receptacle from the first extension cord and a plug from a second extension cord. However, this particular enclosure requires moving parts to clamp ends of each cord within the enclosure for the purpose of keeping the cords stationery with respect to the enclosure. The addition of moving parts increases the production costs of the enclosure while decreasing its reliability due to likelihood of breakage.

U.S. Pat. No. 5,306,176 discloses a tubular housing for the purpose of waterproofing an electrical connection between first and second extension cords. Disadvantages of that enclosure include the requirement of additional threaded moving parts at first and second ends of the enclosure, and the lack of means for providing that the cords are stationery with respect to the enclosure.

U.S. Pat. No. 5,147,216 discloses a water-resistant cylindrical sheath which encloses an electrical connection between first and second electrical cords. Although ends of the sheath include straps to fasten ends of the sheath to their respective cords, the sheath provides no effective means for allowing each cord to be stationery with respect to the sheath, and is thus inadequate in keeping the first and second cords connected when the first and second cords are under tension.

U.S. Pat. No. 4,784,612 also provides an enclosure for a plug and receptacle connection between first and second extension cords. However, that enclosure only allows for a minimum sized plug and receptacle, the enclosure is not capable of accepting plugs and receptacles of varying sizes.

U.S. Pat. No. 5,217,387 also discloses a water-resistant container for housing a connection between the plug in receptacle for first and second extension cords. However, that configuration requires that either the cords have annular ridges which are specifically compatible with the container for maintaining the cords in a stationery position with respect to the container or that additional pieces be attached to the cords for allowing them to be stationery with respect to the container. Therefore, this container requires a multitude of additional parts which decreases its convenience for use in a construction site and increases the unit cost of the device.

U.S. Pat. Nos. 5,129,389 and 5,211,573 each disclose extension cord connection housings. However, both of those housings include sharp corners which allow the connection to catch on corners and ridges within a construction site.

Finally, U.S. Pat. Nos. 5,135,409 and 5,259,782 each disclose various enclosures which have tapered or rounded corners for the purpose of preventing the enclosure from catching on corners or ridges within a construction site. However, those enclosures require either a multitude of parts which must be fastened together with screws or bolts or they require screws or bolts for fastening or clamping the cord to the enclosure for the purpose of keeping the cord stationery. The multitude of fasteners and pieces in those enclosures make them undesirable in a construction site because they require too much time and effort to put into use.

SUMMARY OF THE INVENTION

The present invention recognizes and addresses the foregoing disadvantages, and others of prior art constructions and methods.

Accordingly, it is an object of the present invention to provide an enclosure which keeps a receptacle from a first electrical cord and plug from a second electrical cord fastened together, even when the first and second cords are under tension.

It is another object of the present invention to provide an enclosure which is adapted to enclose a large size range of electrical connections, by utilizing internal gripping means which accommodate electrical connections of having a variety of sizes and shapes.

It is another object of the present invention to provide an enclosure for retaining an electrical connection which is formed from a single piece, simple to injection-mold from a plastic resin, has a smooth ellipsoid outer shape, and which is inexpensively manufactured.

Generally speaking, the present invention relates to an enclosure for releasably retaining and enclosing a connection between a plug attached to a first electrical cord and a receptacle attached to a second electrical cord.

More specifically, the enclosure comprises a lower shell having an inside surface and an upper shell having an inside surface, wherein the upper shell is adapted to matingly engage the lower shell to form an interior space around the connection. The enclosure also includes a hinge for hingedly connecting the upper and lower shells, and for allowing the upper and lower shells to rotate into open and closed positions with respect to one another.

The enclosure further includes a latch for releasably fastening the upper shell onto the lower shell to enclose the plug and receptacle into the enclosure's interior space, and deformable, resilient engagement means formed on an inside surface of the upper or lower shell for deformably engaging lateral surfaces of the plug and receptacle when the latch fastens the upper and lower shells into a closed position. More specifically, a frictional force created between the lateral plug and receptacle surfaces and the engagement means resists separation of the plug and receptacle when the first and second cords are in tension.

The engagement means may be formed as an integral, unitary piece with either the upper or lower shell shells. More specifically, the engagement means may include a protrusion extending from an inside surface the lower or upper shell into the interior enclosure space for deformably engaging first lateral surfaces of the plug and receptacle. If the protrusion is formed on the lower shell inside surface, it extends upwardly from the lower shell into the enclosure interior space. Similarly, if the protrusion is formed on an interior surface of the upper shell, then it may extend downwardly from the upper shell into the enclosure interior space.

In yet another embodiment of the present invention, the enclosure may include a first protrusion extending upward from the lower shell into the interior space, and a second elongated protrusion extending downwardly from the upper shell into the enclosure interior space. In this embodiment, the first protrusion deformably engages first lateral faces of the plug and receptacle connection, and the second protrusion deformably engages second lateral surfaces of the plug and receptacle opposite the first lateral surfaces when the latch fastens the upper and lower shells into a closed position, such that a frictional force created between the lateral plug and receptacle surfaces and the first and second protrusions resists separation of the plug and receptacle when the first and second cords are in tension. The protrusions may be of any shape, but in a preferred embodiment are elongated and run substantially parallel to a longitudinal axis of the enclosure.

The enclosure also includes first and second apertures formed at its first and second ends, respectively, for allowing the first and second cords to pass therethrough. The enclosure may also include deformable, resilient gripping means formed near the enclosure first end for deformably engaging the first cord, such that frictional forces created between the gripping means the first cord resists relative movement between the first cord and the enclosure. The gripping means may also be formed near the second enclosure end. Additionally, the gripping means may be formed on the upper shell, the lower shell or the upper and lower shells.

In a preferred embodiment, the gripping means may be formed as a single, unitary piece with the enclosure. The gripping means may take the form of a plurality of gripping protrusions projecting from an interior surface the upper the lower shell surfaces into the enclosure interior space, or the gripping protrusions may comprise sectional annuli having interior edge portions for engaging the first and second cords.

The interior edge portions of the sectional annuli may be substantially arcuate for engaging cylindrical cords. Additionally, the interior arcuate edge portions for a plurality of sectional annuli may include centers of curvature, and at least one center of curvature of one arcuate edge of one sectional annulus may be offset with respect to a center of curvature of an arcuate edge of an adjacent sectional annulus. The offsetting of adjacent centers of curvature alternatingly and laterally displaces the cords within the enclosure, further facilitating the gripping ability of the sectional annuli and enabling the cords to resist movement with respect to the enclosure. Furthermore, the arcuate the centers of curvature may simply be non-collinear.

In a preferred embodiment, the upper and lower shells form a single, unitary piece, preferably injection-molded from a plastic resin, and the hinge may be a living hinge integrally formed as a unitary piece with the upper and lower shells. Furthermore, although the enclosure may have virtually any three-dimensional shape, a preferred shape of enclosure is an ellipsoid, so that the enclosure does not catch on corners, etc., while being dragged through a construction job site.

In another embodiment of the present invention, the enclosure may include an upper shell hingedly fastened to a lower shell, a crenelated inside surface portion on either of the upper and lower shells, a sheath for receiving a portion of the connection between the first and second cords, wherein the sheath is adapted to fit within the lower shell and further includes means for releasably fixing the sheath to the connection, and a retractable protrusion for engaging the crenelated portion of the shell and securing the connection within the enclosure. In this embodiment, the upper and/or lower shells may include means for engaging the first cord and for securing the cord within the enclosure, as was described above.

Other objects, features and aspects of the present invention are discussed in greater detail below.

BRIEF DESCRIPTION OF THE DRAWINGS

The accompanying drawings illustrate the preferred embodiment of the invention, and serve to aid in the explanation of the principles of the invention.

DETAILED DESCRIPTION OF THE INVENTION

Figure 1:
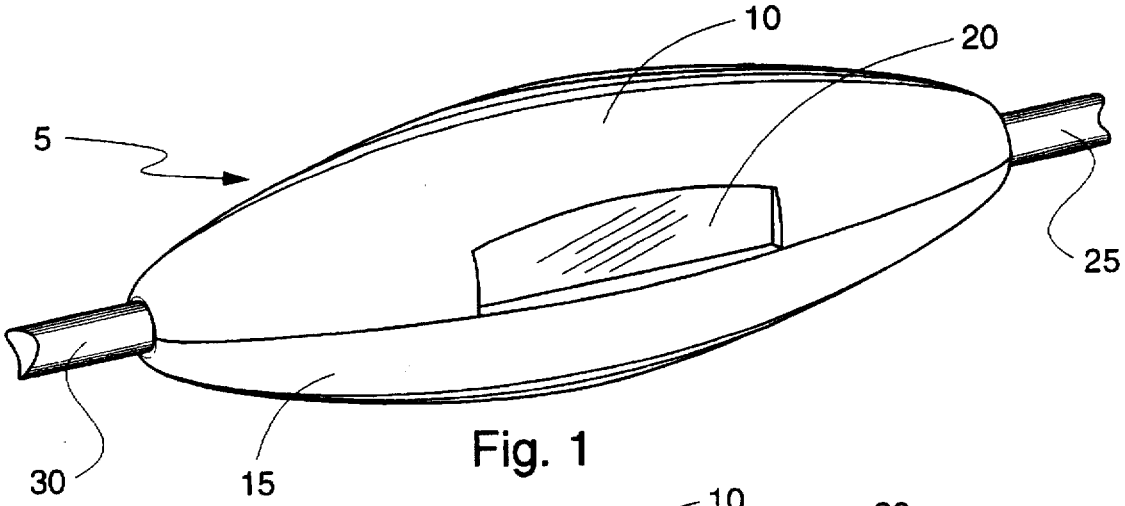
FIG. 1 is a perspective view of the enclosure according to the present invention.

Referring now to the figures in greater detail, FIG. 1 illustrates a first embodiment of the connection enclosure 5. Although enclosure 5 may be of any known solid shape, an ellipsoid shape for enclosure 5 is preferred because it contains no corners for the enclosure to present when the enclosure is being dragged through a construction site. Therefore, without corners, the enclosure is less likely to catch on corners, obstructions, ridges or equipment than standard unenclosed connections or connections which have been tied into a knot to prevent separation of the plug from its receptacle. Enclosure 5 is comprised of upper shell 10 and lower shell 15. Upper shell 10 includes a recessed portion or depression 20 which allows a consumer to grip that area of the enclosure and dislodge the latch to open up the enclosure and expose the connection between cords 25 and 30.

Figure 2:
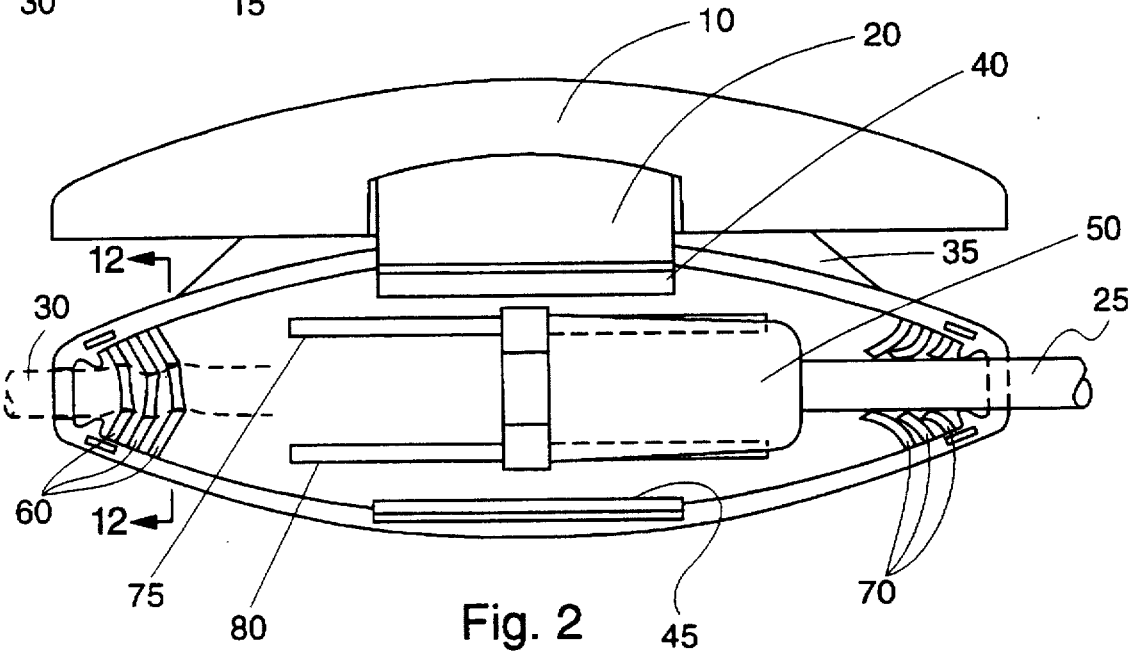
FIG. 2 is top plan view of the enclosure in an open position, illustrating a receptacle portion of an electrical connection in the enclosure interior space.

FIG. 2 illustrates a top plan view of the enclosure in an open position. Upper and lower shells 10 and 15 are connected by a living hinge 35. A latch fastens the upper and lower shells together and is comprised essentially of an upper ridge 40 which interconnects with a lower ridge 45 on lower shell 15. FIG. 2 illustrates only one-half of a connection within the enclosure 5. Specifically, a receptacle 50 and cord 25 are shown as being set into the lower shell 15. There are several ways of gripping the cords 25 and 30. In this particular embodiment cord 25 may be engaged by a plurality of deformable protrusions 70 emanating from an interior surface of lower shell 15. Upon placement of cord 25 within lower shell 15, protrusions 70 are laterally displaced and frictionally engage cord 25 so as to hinder movement of cord 25 with respect to the enclosure. Protrusions 70 may comprise straight protrusions which emanate from an inside surface of the lower shell 15 or they may comprise sectional annuli having interior semicircular edges which deformably engage cord 25. Alternatively, a set of more stiff protrusions 60 are illustrated on a left side of lower shell 15 as engaging cord 30 (shown in dashed lines). In this example each protrusion 60 may also comprise a sectional annulus having an interior semicircular edge which engages the cord. However, centers of curvature for each semicircular or curved edge in each sectional annulus may be offset with respect to one another or may alternate on either side of a center line of the enclosure so as to cause the cord 30 to be laterally displaced into a zig-zag configuration, thereby mitigating any movement of cord 30 with respect to lower shell 15.

Figure 3:
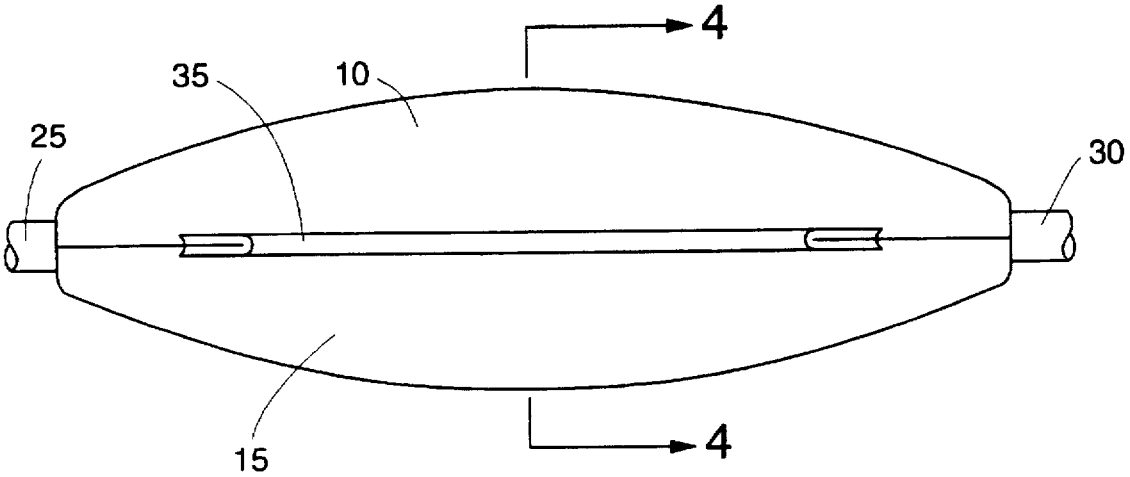
FIG. 3 is a rear plan view of the enclosure.
Figure 4:
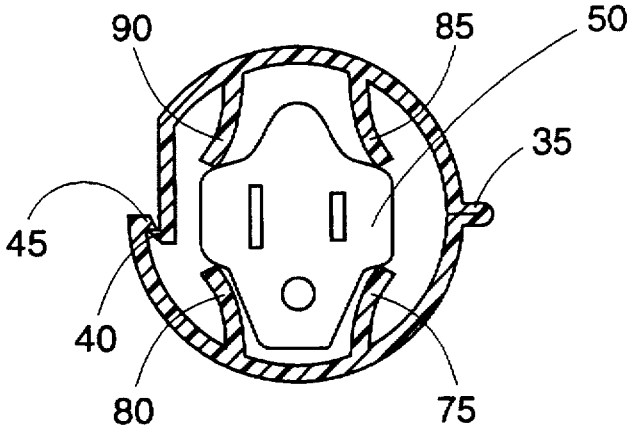
FIG. 4 is a cross-sectional view of the enclosure according to the present invention, taken along line 4—4 of FIG. 3, illustrating protrusions deformably engaging a receptacle portion of the electrical connection.

FIG. 3 shows a rear view of the enclosure in accordance with the present invention. FIG. 3 best shows the live hinge 35 which is connected to upper and lower shells 10 and 15. FIG. 4 is a cross-sectional view of the enclosure 5 illustrated in FIGS. 1 through 3, taken along line 4—4 of FIG. 3. FIG. 4 illustrates elongated protrusions 75 and 80 emanating from an inside surface of lower shell 15, and protrusions 85 and 90 which originate from an inside surface of upper shell 10. As is illustrated in FIG. 4, each of the protrusions deforms when the enclosure is entirely closed. Thus, when upper ridge 40 engages lower ridge 45 of the latch to fasten the enclosure into an enclosed position, receptacle 50 laterally and resiliently displaces protrusions 85 and 90 as well as protrusions 75 and 80. Although not shown, a plug portion in the connection also displaces protrusions 75–90 in a manner similar to receptacle 50. Frictional forces created between both the receptacle 50 and its mating plug and between each of the deflected protrusions 75 through 90 resist any tensile force which would separate the plug (not shown from receptacle 50). Additionally, the flexible engaging protrustions 75–90 allow for the enclosure to accommodate varying sizes and types of receptacle and plug connection pairs within the enclosure.

Figure 12:
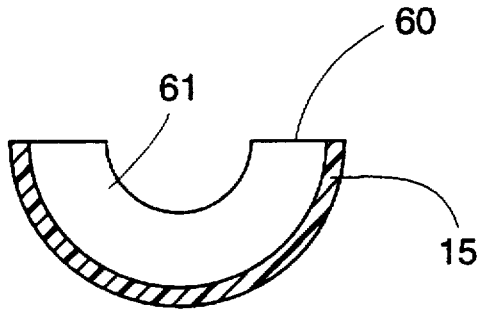
FIG. 12 illustrates a cross-sectional view of a lower shell of the first embodiment, taken along line 12—12 of FIG. 2.

Referring to FIGS. 2 and 12, sectional annulus 60 should have a greater stiffness than flexible protrusion 70 so that a cord 30 shown in dashed lines may be laterally displaced by the alternating centers of curvature of each inside semicircular edge of each sectional annulus 60. FIG. 12 illustrates an example of a sectional annulus 60. Each sectional annulus 60 originates from an inside surface of lower shell 15 and includes an inside circular edge 61 which engages the cord.

Figure 8:
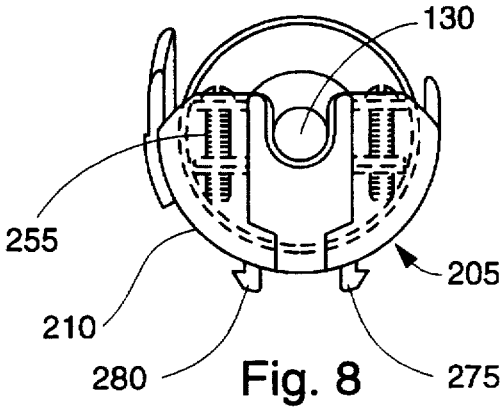
FIG. 8 illustrates a right side plan view of the sheath and electrical connection shown in FIG. 7.
Figure 9:
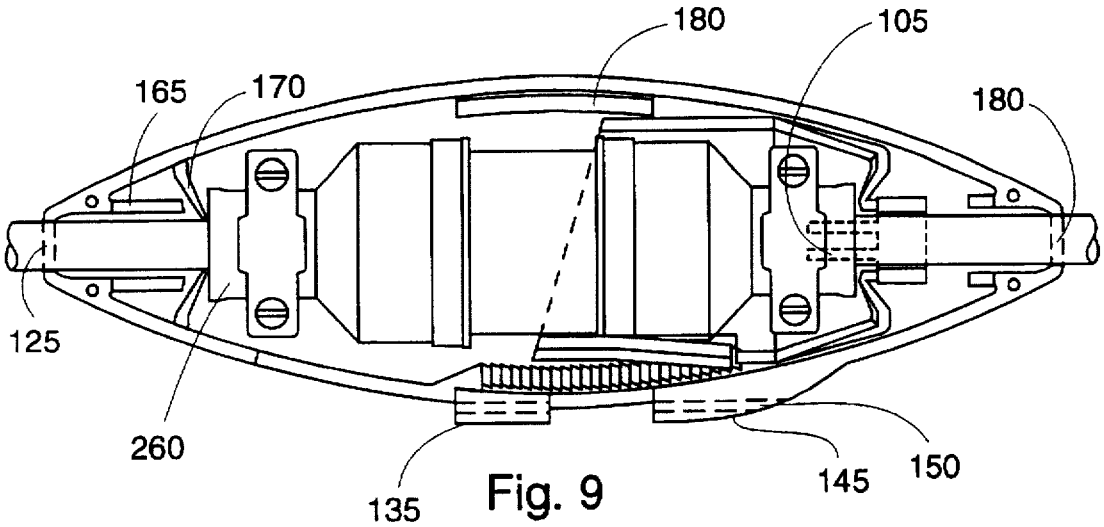
FIG. 9 illustrates a top plan view of a lower shell of the second embodiment, showing the sheath and electrical connection inside of the lower shell.
Figure 10:
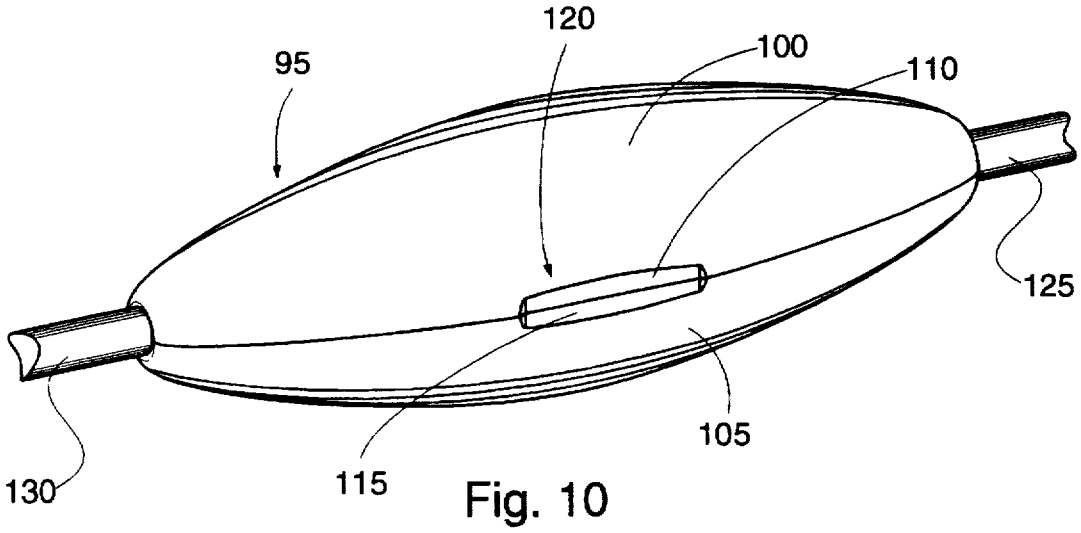
FIG. 10 illustrates a front perspective view of the second embodiment of enclosure in a closed position.
Figure 11:
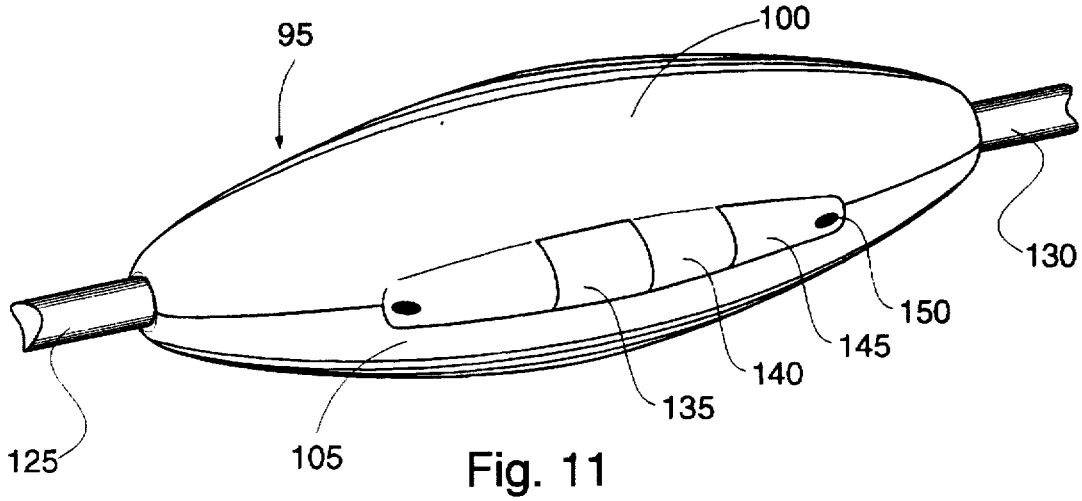
FIG. 11 illustrates a rear perspective view of the second embodiment of enclosure in a closed position.

FIGS. 5 through 11 illustrate a second embodiment of the present invention. Referring to FIG. 10 enclosure 95 includes an upper shell 100 and a lower shell 105. The plug enclosure 95 also includes a gripping area 120 comprised of an upper indentation 110 and a lower indentation 115 for allowing a user to unlatch the enclosure and open the enclosure to expose receptacle and plug of a connection between cords 125 and 130. FIG. 11 illustrates a rear prospective view of enclosure 95 illustrating first lower shell hinged portion 135, second lower shell hinged portion 145, first upper shell hinged portion 140 and hinge bore 150 through all of the hinged portions. Hinge bore 150 accepts a pin for allowing upper shell 100 to rotate with respect to lower shell 105 via hinged portions 135, 140 and 145.

Figure 5:
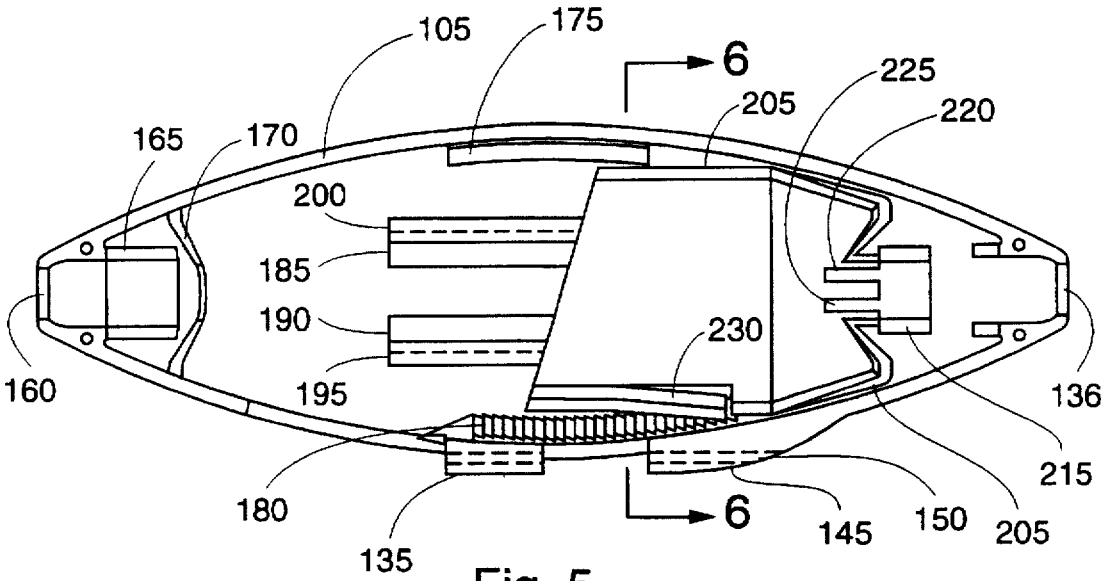
FIG. 5 is a top plan view of a lower shell of a second embodiment according to the present invention, illustrating a sheath inside of the lower shell.

FIG. 5 illustrates the lower shell 105 in greater detail. Referring to a left side of FIG. 5, lower shell 105 includes a semicircular bore 160 for accepting cord 125 and a semicircular boss 165 for supporting the cord 125 within the lower shell 105. A retaining ring 170 essentially comprised of a semicircular annulus having an inside edge is exposed just slightly to the right of semicircular boss 165. In a manner similar to the other embodiment, the enclosure 95 also includes a latch having a lower ridge 175 which engages with an upper ridge (not shown) of the upper shell to enclose the electrical connection. An inside surface of lower shell 105 includes a crenelated portion 180 for engaging a retractable protrusion 230 on a sheath 205 as is discussed in greater detail below. As was discussed above, lower shell includes hinge portions 135 and 145 having bore 150 extending therethrough. Additionally, lower shell 105 includes a semicircular bore 136 for allowing cord 130 to pass therethrough. Finally, lower shell 105 include elongated slots 185 and 190 for assisting in the positioning of the plug sheath 205 with respect to the lower shell 105.

Figure 6:
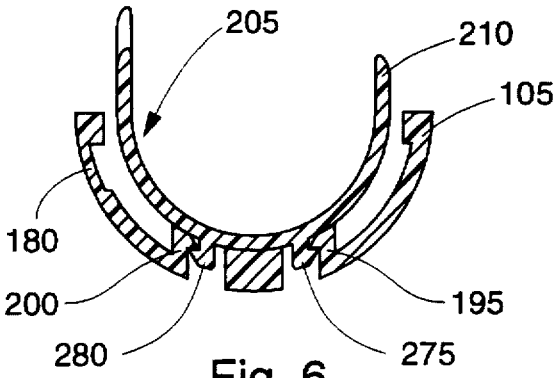
FIG. 6 is a cross-sectional view of the second embodiment of the present invention, taken along line 6—6 of FIG. 5.
Figure 7:
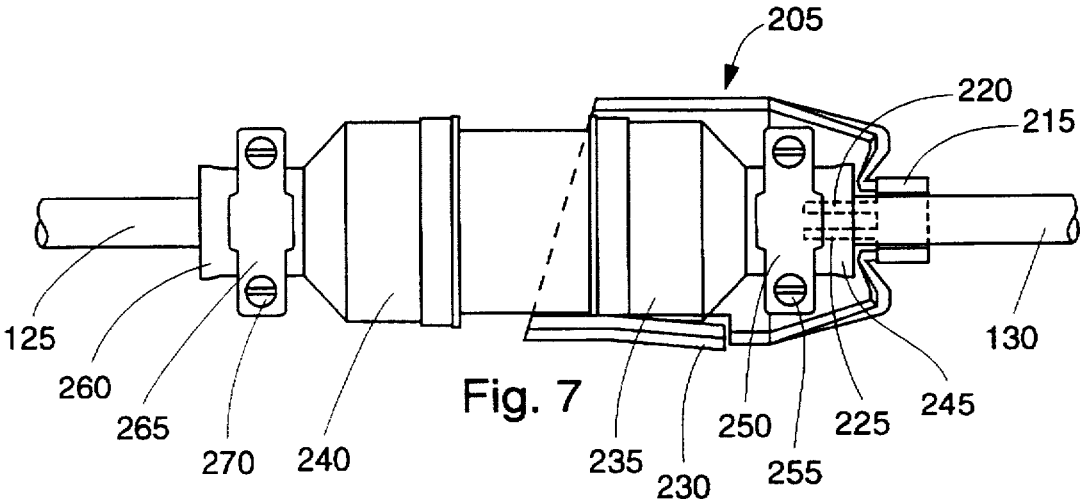
FIG. 7 illustrates an electrical connection between first and second electrical cords, with a sheath mounted on one portion of the connection.

Referring now to FIGS. 6–8, plug sheath 205 is attached to a portion of a connection between plug 235 and receptacle 240. Plug sheath 205 includes a semicylindrical sheath wall 210 in a semicylindrical neck 215 for accepting cord 130. Plug sheath 205 includes prong inserts 220 and 225 which may be accepted into the plug assembly 235 for fastening the sheath to the plug assembly. Before screws 255 are tightened down onto bracket 250, prong inserts 220 and 225 are inserted between clamp 245 and cord 130, then screws 255 are tightened so as to fix plug sheath 205 to the plug 235. Although in this embodiment prongs 220 and 225 are utilized to connect the plug sheath 205 to the plug 235, any known means of connection may be used here including but not limited to hose clamps, screws, glue or any other known means for attaching one structure to another.

FIG. 6 shows a cross-sectional view of the plug sheath and lower shell in greater detail. Specifically, the plug sheath 205 sits within the belly of lower shell 105. Plug sheath 205 includes elongated protrusions 280 and 275 which fit through elongated slots 185 and 190 to engage lower shell protrusions 195 and 200. Additionally, plug sheath 205 includes a retractable protrusion 230 which engages a crenelated portion of inside 180 of an inside surface of lower shell 105.

In operation of the second embodiment, after sheath 205 has been placed onto the connection it is inserted into the lower shell as is illustrated in FIG. 9. After the connection and sheath are inserted into the lower shell and the protrusions 280 and 275 interlock with protrusions 195 and 200 the sheath 205 slides to the left until clamp portion 260 engages retaining ring 170. Since the retractable protrusion engages the crenelated portion 230, the sheath may not move to the right against the crenelations until the retractable protrusion is retracted away from the crenelated portion. Thus, once the clamp portion 260 engages the retaining ring 170 the plug and receptacle 235 and 240 are prevented from separation.

Outer shells of the first and second embodiment may be manufactured from any material. However, in a preferred embodiment they are injection molded from plastic. Furthermore, enclosure 5 is preferably injection molded as a single unitary piece. However, the stiffness of the plastic will depend upon whether flexible protrusion 70 or more stiff annular protrusion 60 are utilized. Additionally, shells 100 and 105 are preferably injection molded from any known plastic resin material and plug sheath 205 may also be manufactured from either injection molded plastic or metal.

In both embodiments of the present invention the outer sheath should be smooth and impact resistant. Both embodiments of the present invention readily accommodate plugs and receptacles of plugs of any size and contain few individual parts which reduces the manufacturing cost of both embodiments.

It should be understood that various changes to the present invention may be made by the ordinarily skilled artisan, without departing from the spirit and scope of the present invention which is presented in the claims below. The ordinarily skilled artisan will understand that this disclosure presents an example of the invention and is not meant to limit the invention, as presented in the claims, in any way whatsoever.

What is claimed is:

1. An enclosure for releasably retaining and enclosing a connection between a plug attached to a first electrical cord and a receptacle attached to a second electrical cord said enclosure comprising:

a lower shell having an inside surface;

an upper shell including an inside surface, and means for matingly engaging said upper shell to said lower shell to form a closed enclosure having an interior space configured to surround the connection;

a hinge connecting said upper and lower shells, and adequate to allow said upper and lower shells to rotate into open and closed positions with respect to one another;

a latch adapter to releasably fasten said upper shell to said lower shell; and a resilient engagement means formed on an inside surface of one of said upper and lower shell, said resilient engagement means formed as an integral, unitary piece with one of said upper and lower shells, said engagement means adapted to deformably engage first lateral surface of said plug and receptacle when the latch fastens the upper and lower shells into a closed position, whereby a frictional force created between the lateral plug and receptacle surfaces and the engagement means resists separation of the plug and receptacle when the first and second cords are in tension.

2. The enclosure of claim 1 wherein said engagement means includes a protrusion extending from an inside surface of one of said lower and upper shells into said interior enclosure space for deformably engaging first lateral surfaces of the plug and receptacle.

3. The enclosure of claim 2, wherein said protrusion is elongated and runs substantially parallel to a longitudinal axis of said enclosure.

4. The enclosure of claim 3, wherein said protrusion extends upwardly from said lower shell into the enclosure interior space.

5. The enclosure of claim 3, wherein said protrusion extends downwardly from said upper shell into the enclosure interior space.

6. The enclosure of claim 4 further including:

a second elongated protrusion extending downwardly from the upper shell into the enclosure interior space for deformably engaging second lateral surfaces of the plug and receptacle opposite the first lateral surfaces when said latch fastens said upper and lower shells into a closed position, such that a frictional force created between the lateral plug and receptacle surfaces and the first and second protrusions resists separation of the plug and receptacle when the first and second cords are in tension.

7. The enclosure of claim 1 wherein said enclosure includes:

first and second ends;

first and second apertures formed at said first and second ends, respectively, for allowing the first and second cords to pass through said first and second ends into the enclosure interior space, respectively; and deformable, resilient gripping means formed near said first enclosure end for deformably engaging the first cord, such that frictional forces created between the gripping means and the first cord resists relative movement between the first cord and said enclosure.

8. The enclosure of claim 7 wherein said enclosure includes:

said gripping means formed near said second enclosure end.

9. The enclosure of claim 7 wherein said enclosure includes:

said gripping means formed on said upper shell inside surface.

10. The enclosure of claim 7 wherein said enclosure includes:

said gripping means formed on said lower shell inside surface.

11. The enclosure of claim 7 wherein said enclosure includes:

said gripping means formed on said upper and lower shell inside surfaces.

12. The enclosure of claim 7 wherein said enclosure wherein:

said gripping means is formed unitarily with the enclosure.

13. The enclosure of claim 7 wherein said gripping means further comprise:

a plurality of gripping protrusions projecting from an interior surface of one of said upper and lower shell surfaces into said enclosure interior space.

14. The enclosure of claim 13 wherein said gripping protrusions comprise sectional annuli having interior edge portions for engaging one of said first and second cords.

15. The enclosure of claim 14 wherein said interior edge portions are substantially arcuate.

16. The enclosure of claim 15 wherein said interior arcuate edge portions include centers of curvature, and wherein at least one center of curvature of one arcuate edge of one sectional annulus is offset with respect to a center of curvature of an arcuate edge of an adjacent sectional annulus.

17. The enclosure of claim 15 wherein said arcuate edge portions include centers of curvature, and wherein said centers of curvature are non-collinear.

18. The enclosure of claim 1, wherein:

said upper and lower shells form a single, unitary piece; and said hinge is a living hinge integrally formed as a unitary piece with said upper and lower shells.

19. The enclosure of claim 1 wherein said enclosure is ellipsoid-shaped.

20. An enclosure for releasably retaining and enclosing a connection between a plug attached to a first electrical cord and a receptacle attached to a second electrical cord, said enclosure comprising:

a lower shell including an inside surface, and an upper shell having an inside surface, said upper shell including means for matingly engaging said lower shell to form a closed enclosure having an interior space configured around the connection;

means for hingedly connecting said upper and lower shell, and adapted to allow said upper and lower shells to rotate into open and closed positions with respect to one another;

a latch adapted to releasably fasten said upper shell to said lower shell;

a first aperture formed at a first end of said enclosure, and a second aperture formed at a second end of said enclosure, for allowing the first and second cords to pass through said first and second ends of said enclosure, respectively; and least a pair of resilient, gripping protrusions wherein one protrusion is laterally offset from the other for defining a cord channel, said protrusions carried within said interior space of said enclosure near said first aperture, said protrusions being substantially flat and angled toward the center of said enclosure, whereby frictional forces created between said pairs of gripping protrusions and the first cord resists relative movement between the first cord and said enclosure.

21. The enclosure of claim 20 wherein said enclosure includes:

a second pair of resilient gripping protrusions wherein one protrusion is laterally offset from the other for defining an extension of said cord channel for receiving said second cord, said second pair of protrusions carried within said interior space of said enclosure near said second aperture, said second pair of protrusions being substantially flat and angled toward the center of said enclosure, whereby frictional forces created between said pairs of gripping protrusions and either of said first or second cord resists relative movement between a respective of either said first or second cord and said enclosure.

22. The enclosure of claim 20 wherein said enclosure includes:

said gripping means formed on said upper shell.

23. The enclosure of claim 20 wherein said enclosure includes:

said gripping means formed on said lower shell.

24. The enclosure of claim 20 wherein said enclosure includes:

said gripping means formed on upper and lower shells.

25. The enclosure of claim 20 wherein said enclosure includes:

said gripping means formed unitarily with the enclosure.

26. The enclosure of claim 20 wherein said gripping means further comprise:

a plurality of gripping protrusions projecting from an interior surface of one of said upper and lower shells into said enclosure interior space.

27. The enclosure of claim 20 wherein said gripping protrusions comprise sectional annuli having an interior edge portions for engaging the first cord.

28. The enclosure of claim 27 wherein said interior edge portions are substantially arcuate.

29. The enclosure of claim 28 wherein said interior arcuate edge portions include centers of curvature, and wherein at least one center of curvature of one arcuate edge of one sectional annulus is offset with respect to a center of curvature of an arcuate edge of an adjacent sectional annulus.

30. The enclosure of claim 28 wherein said arcuate edge portions include centers of curvature, and wherein said centers of curvature are non-collinear.

31. The enclosure of claim 20 wherein said enclosure is ellipsoid-shaped.

32. The enclosure of claim 19, wherein:

said upper and lower shells form a single, unitary piece; and said hinge is a living hinge integrally formed as a unitary piece with said upper and lower shells.

33. An enclosure for releasably retaining and enclosing a connection between a plug attached to a first electrical cord and a receptacle attached to a second electrical cord comprising:

a lower shell having an inside surface;

an upper shell including an inside surface, and means for matingly engaging said upper shell to said lower shell to form a closed enclosure having an interior space configured around the connection, said lower shell inside surface further including a crenelated portion;

a hinge for connecting said upper and lower shells, and adapted to allow said upper and lower shells to rotate into open and closed positions with respect to one another;

a latch adapted to releasably fasten said upper shell to said lower shell; and a sheath for receiving a portion of the connection between the first and second cords, wherein said sheath is adapted to fit within said lower shell and further includes a clam for clamping said first cord to said sheath, and a retractable protrusion for engaging said crenelated portion of said shell and for securing the connection within the enclosure.

34. The enclosure of claim 33 further including:

means for engaging the first cord and for securing the cord within the enclosure.

35. The enclosure of claim 33, wherein:

said enclosure is ellipsoid shaped.

36. The enclosure of claim 20 including a second pair of resilient, gripping protrusions disposed offset behind said first pair of protrusions, said second pair of protrusions being substantially flat and angled toward the center of said enclosure for further providing resistant frictional force on said first cord for maintaining the interconnection between said first and second cord.

* * * * *